United States Patent [19]

Pearson

[11] Patent Number: 4,762,080

[45] Date of Patent: Aug. 9, 1988

[54] CONSUMABLE REPLACEABLE BOW GUARD

[76] Inventor: Bruce E. Pearson, P.O. Box 1445, Prescott, Ariz. 86302

[21] Appl. No.: 44,949

[22] Filed: Apr. 30, 1987

[51] Int. Cl.[4] ..... B63B 59/02

[52] U.S. Cl. ..... 114/219; 114/343

[58] Field of Search ..... 114/219, 343, 344, 357, 114/361; 296/1 R, 41, 188, 189, 199; 293/126, 218; 428/200, 202

[56] References Cited

U.S. PATENT DOCUMENTS

| | | | |
|---|---|---|---|
| 3,055,022 | 9/1962 | Vallquist | 114/219 |
| 3,220,026 | 11/1965 | Lichti | 114/343 |
| 3,916,055 | 10/1975 | Wagner | 293/228 |
| 4,498,697 | 2/1985 | McGlone et al. | 293/128 |
| 4,577,205 | 3/1986 | Shibata et al. | 428/202 |
| 4,667,619 | 5/1987 | Nishida | 114/361 |

*Primary Examiner*—Joseph F. Peters, Jr.
*Assistant Examiner*—Stephen P. Avila
*Attorney, Agent, or Firm*—Nissle & Leeds

[57] ABSTRACT

An universal type, mar-inhibiting removable ablative bow guard system for protecting the bow of a boat from corrosion and from abrasion damage by the ground.

3 Claims, 1 Drawing Sheet

CONSUMABLE REPLACEABLE BOW GUARD

This invention relates to apparatus for pretecting the hull structure of a boat from corrosion and from abrasion damage by the ground.

More particularly, the invention relates to a universal type, mar-inhibiting, removable ablative bow guard system for protecting boat bow structures having different sizes which reside within a defined range of sizes and for altering the hydrodynamic flow of water over the boat bow structures.

In a further respect, the invention relates to a bow guard system of the type described in which an ablative bow guard is attached to the hull of a boat with a non-water soluble adhesive which is readily removed from the hull by contacting the adhesive with a common household solvent or with heat.

A motor boat, canoe, or other relatively small pleasure craft is, after use on a lake or in the ocean, often pulled up on a beach or shore. Consequently, the bow of the boat is abraded by sand or rocks on the beach. The abrasions in the hull promote corrosion and structural weakening of the hull of the boat. Such corrosion and weakening of the hull of a boat can, particularly if the hull is fabricated from fiberglass, necessitate repair or replacement of the entire bow portion of the boat. The walls forming the bow of the boat taper together to form a leading edge which facilitates slicing of the bow through water while the boat is traveling over the surface of a body of water. The lower portion of this leading edge tends to incur most of the damage when the bow and hull of a boat are dragged onto a beach. While the damage incurred to the hull of a boat during movement of the boat onto and from a beach can, over time, be extensive, such damage has been accepted by boat owners as an expected occurrence associated with the use of a boat. One important reason why abrasion damage to the existing hull structure is accepted as part of the normal use of the boat is that the bow and hull of a boat are specially designed to produce an efficient hydrodynamic flow of water over the surface of the hull and to produce a structurally sound hull. Any changes in the shape of the hull or any attachments to the hull which alters the structural integrity thereof are not reasonably considered because such would alter the efficient hydrodynamic movement of the hull through water.

Accordingly, it would be highly desirable to provide a bow guard system which could, while not requiring that the structural integrity of an existing boat bow be altered, protect the bow of a boat from damage incurred when the boat is pulled or moved over the ground on a shoreline.

It would also be highly desirable to provide an improved bow guard system which could be readily utilized on different boat bow structures having different sizes which reside within a defined range of sizes and which could, after the components used in the system became worn or damaged, be readily removed from a boat and replaced.

Therefore, it is a principal object of the invention to provide an improved system for protecting the prow of a boat when the boat is pulled over the ground along a lake or an ocean.

Another object of the invention is to provide an improved bow guard system which can be utilized on a boat without affecting the existing structural integrity of the bow of a boat or requiring the modification of any of the structural components of the bow of the boat, and which can, after use, be readily removed from the boat without affecting the structural integrity of the bow of the boat.

Still another object of the invention is to provide an improved boat bow guard system which can be readily used on different boat bow structures having different sizes which reside with a defined range of sizes and which can, after the components used in the system become worn or damaged, be readily removed from a boat and replaced.

Yet another object of the instant invention is to provide an improved boat bow guard system which minimizes the frictional resistance forces between a boat hull and the ground when a boat is pulled or moved onto a shore.

These and other, further and more specific objects and advantages of the invention will be apparent to those skilled in the art from the following detailed description thereof, taken in conjunction with the drawings, in which.

Briefly, in accordance with my invention, I provide an improved universal type, mar-inhibiting, removable ablative bow guard system for protecting different boat bow structures having different sizes which reside within a defined range of sizes and for altering the hydrodynamic flow of water over said boat bow structures. The boat bow structures each have a pair of outer walls at an acute angle with respect to one another and terminating in generally V-shaped relationship at a fixed leading edge having an arcuate convex longitudinal lower portion with a defined, fixed curvature. The lower portion contacts, moves over and is abraded by the ground when the boat is moved onto a beach. The bow guard system includes an elongate V-shaped deformably ablative bow guard having a pair of elongate panel shaped arm members terminating at an edge, the arm members being shaped and dimensioned and deformable toward and away from one another, the bow guard being deformable along its longitudinal length to alter the longitudinal curvature of the bow guard, the bow guard, by virtue of deformation of said arm members and the bow guard along its longitudinal length, conforming to any boat bow lower portion characterized by said defined range of sizes; and, a layer of non-water soluble adhesive removably securing the bow guard arm members to the lower portion of the fixed leading edge to alter the hydrodynamic flow of water over the lower portion.

Figure 1:
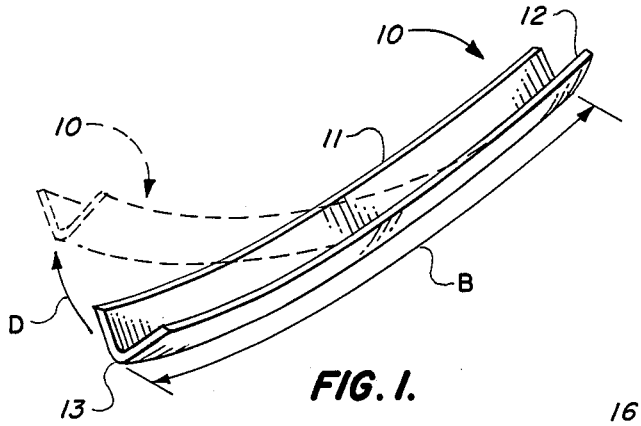
FIG. 1 is a perspective view illustrating an ablative deformable boat bow guard constructed in accordance with the principles of the invention.
Figure 2:
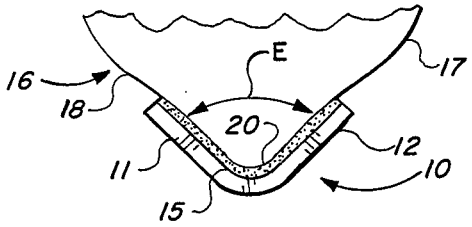
FIG. 2 is a front view of the deformable boat bow guard of FIG. 1 illustrating the mode of operation thereof.
Figure 3:
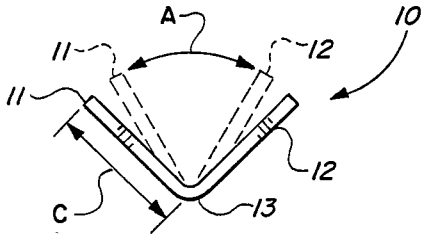
FIG. 3 is a front view illustrating the bow guard of FIGS. 1 and 2 installed on the bow of a boat with removable adhesive in accordance with the invention.
Figure 4:
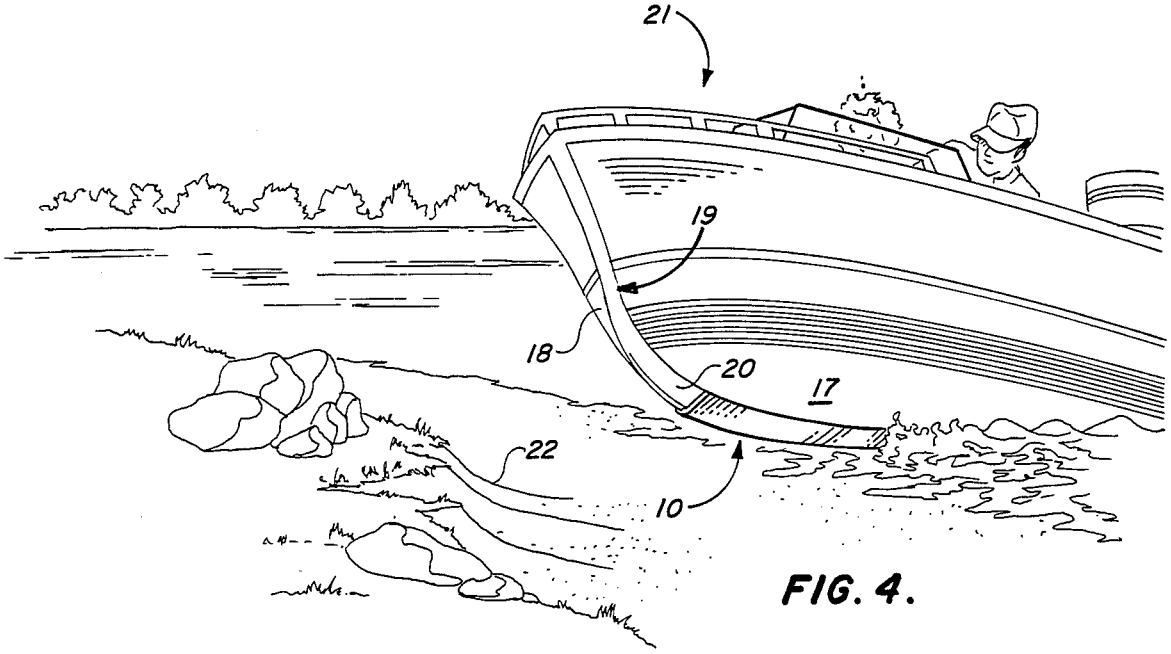
FIG. 4 is a perspective view illustrating a boat equipped with the bow guard system of the invention being slowly moved on shore.

Turning now to the drawings, which depict the presently preferred embodiments of the invention for the purpose of illustrating the practice thereof and not by way of limitation of the scope of the invention, and in which identical reference characters represent corresponding elements throughout the several views, FIGS. 1 to 4 illustrate a bow guard system constructed in accordance with the principles of the invention and including an elongate V-shaped deformable ablative bow guard 10 having a pair of elongate panel shaped arm members 11 and 12 terminating at an edge 13. Arm members 11 and 12 are, as indicated by arrows A in FIG. 3, deformable toward and away from one another. Edge 13 is convex and has a arcuate length indicated by arrows B in FIG. 1. Bow guard 10 is also deformable along its longitudinal length to increase the curvature of guard 10 in the manner indicated by arrow D and the ghost out line of guard 10 in FIG. 1, or, in a similar manner, to decrease the curvature of guard 10 by deforming or bending guard 10 in a direction opposite that of arrow D. Guard 10 can be made from metal or any other deformable material but is presently preferably fabricated through an injection molding process with a plastic or thermoplastic material that will adhere to contact cement of the type which can be used on boat having fiberglass hulls. The arcuate length B of bow guard 10 is presently preferably approximately four feet while the width C of each arm member 11 and 12 is approximately three inches. As shown in FIG. 2, bow guard 10 is secured to the hull 16 of a boat with adhesive 15. Adhesive 15 is non-water soluble and can be removed by directing hot air from a hair blow dryer against guard 10 and adhesive 15. Such adhesive is commonly used to secure molding to the sides of automobiles. Alternatively, an adhesive can be utilized which is soluble in sodium hypochlorite, vinegar, ammonia, corn oil, vegetable oil or other common household solvents. Such adhesives are readily known to those of skill in the adhesive art. Hull 16 includes outer walls 17 and 18 at an acute angle E with respect to one another and terminating in generally V-shaped relationship at a fixed leading edge 19 having an arcuate convex longitudinal lower portion 20 with a defined, fixed longitudinal curvature. When hull 16 is moved over the ground, lower portion 20 generally contacts, moves over, and is abraded by the ground.

Bow guard 10 is preferably fabricated from an ablative plastic or other material which is gradually torn away when the hull 16 of a boat 21 moves over a shoreline 22. The tearing away of portions of guard 10 tends to minimize frictional forces between the shoreline 22 and boat 21 and facilitate movement of boat 21 over the ground. When it is desired to replace consumable bow guard 10 with a new bow guard, adhesive 15 is removed by directing a stream of hot air from an air blow dryer against bow guard 10 and adhesive 15. After the hot air stream is directed against adhesive 15 and guard 10 for the necessary period of time, guard 10 is peeled or pulled away from hull 16 and adhesive 15 is removed from hull 16. A new bow guard 10 is secured to hull 16 with new adhesive 15. When a bow guard 10 is attached to hull 16, the longitudinal curvature of guard 10 corresponds to that of lower portion 20 covered by guard 10.

The mounting of bow guard 10 on hull 16 generally does not increase the structural strength of hull 16 and does not require altering the form of walls 17 and 18 or of any other structural bracing (not visible) for walls 17 and 18 of hull 16. Addition of guard 10 does, in direct contradiction to the teaching of the art, produce a relatively soft consumable bow surface and alter the hydrodynamic flow of water over the existing hull 16; however, the protection afforded the leading edge 20 of hull 16 is believed to offset any degradation which may occur in the hydrodynamic performance of hull 16.

PVC, teflon and other relatively smooth, frictionless ablative materials are presently preferred in the fabrication of bow guard 10.

Having described my invention in such terms as to enable those skilled in the art to understand and practice it, and having identified the presently preferred embodiments thereof, I claim:

1. A universal type, marinhibiting, removable ablative bow guard system for protecting different boat bow structures having different sizes which reside within a defined range of sizes and for altering the hydrodynamic flow of water over said boat bow structures, said bow structurs each having a pair of outer walls at an acute angle with respect to one another and terminating in generally V-shaped relationship at a fixed leading edge having an arcuate convex longitudinal lower portion with a defined, fixed curvature, said lower portion contacting, moving over and being abraded by the ground when said boat is moved onto a beach, said bow guard system including (a) an elongate V-shaped deformable consumable ablative bow guard strip having a pair of elongate panel shaped arm members terminating at an edge, said arm members being shaped and dimensioned and deformable toward and away from one another, said bow guard being deformable along its longitudinal length to alter the longitudinal curvature of said bow guard, said bow guard, by virtue of deformation of said arm members and said bow guard along its longitudinal length, being shaped and dimensioned to conform to and cover, without actually extending from said leading edge over said walls, the fixed leading edge of any boat bow lower portion characterized by said defined range of sizes; and, (b) a layer of non-water soluble adhesive removably securing said bow guard arm members to said lower portion of said fixed leading edge to alter hydrodynamic flow of water over said lower portion, portions of said bow guard being torn away when said boat bow is moved onto a beach to minimize frictional forces between the beach and bow guard.

2. The bow guard of claim 1 wherein said adhesive decomposes and can be removed from said hull when a stream of hot air is directed against said bow guard.

3. The bow guard of claim 1 wherein said adhesive decomposes and can be readily removed from said hull when contacted with a chemical solvent in the class consisting of sodium hypchlorite, vinegar, ammonia, corn oil, and vegetable oil.

* * * * *